US010539316B2

(12) United States Patent
Ji et al.

(10) Patent No.: US 10,539,316 B2
(45) Date of Patent: Jan. 21, 2020

(54) LIGHT DISTRIBUTION SYSTEM FOR FREEZER

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Feng Ji, Zhejiang (CN); Zhaoyong Zheng, Zhejiang (CN); Bozhang Xu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/201,424

(22) Filed: Nov. 27, 2018

(65) Prior Publication Data

US 2019/0162402 A1 May 30, 2019

(30) Foreign Application Priority Data

Nov. 28, 2017 (CN) ..... 2017 1 1210135

(51) Int. Cl.

| | |
|---|---|
| ***F21V 33/00*** | (2006.01) |
| ***F21V 5/04*** | (2006.01) |
| ***F21V 7/04*** | (2006.01) |
| ***F21V 7/00*** | (2006.01) |
| ***F21V 13/04*** | (2006.01) |

(Continued)

(52) U.S. Cl.

CPC ..... *F21V 33/0044* (2013.01); *F21V 5/04* (2013.01); *F21V 7/005* (2013.01); *F21V 7/04* (2013.01); *F21V 13/04* (2013.01); *F25D 27/00* (2013.01); *A47F 3/04* (2013.01); *F21S 4/20* (2016.01); *F21S 4/28* (2016.01); *F21V 5/043* (2013.01); *F21V 5/08* (2013.01); *F21V 7/0008* (2013.01); *F21V 9/14* (2013.01); *F21V 19/001* (2013.01); *F21W 2131/305* (2013.01); *F21Y 2103/10* (2016.08); *F21Y 2115/10* (2016.08)

(58) Field of Classification Search

CPC ... F21V 5/043; F21V 5/04; F21V 5/08; F21V 33/0044; F21V 7/04; F21V 7/005; F21V 13/04; F21V 19/001; F21V 19/14; F25D 27/00; F21W 2131/305; F21S 4/20; F21S 4/28; F21S 8/00

See application file for complete search history.

(56) References Cited

U.S. PATENT DOCUMENTS 5,301,092 A * 4/1994 Santosuosso ..... A47F 3/001 312/223.5
6,837,605 B2 * 1/2005 Reill ..... F21V 5/04 362/555

(Continued)

*Primary Examiner* — Bryon T Gyllstrom
*Assistant Examiner* — Colin J Cattanach
(74) *Attorney, Agent, or Firm* — Wang Law Firm, Inc.

(57) ABSTRACT

A light distribution system for freezer that includes a LED strip light disposed on a freezer door. The LED strip lamp includes a lamp holder, a strip-shaped polarizing lens, and a plurality of LED chips. The lamp holder includes a lens setting surface and a reflecting surface. The strip-shaped polarizing lens includes a plurality of optical axis, an incident surface, a first and second convex lens exit surfaces, and a transition surface. An angle between the illuminated surface and the optical axis includes an acute angle and the illuminated surface includes a main light region illuminated by the outgoing light of the first and second convex lens exit surfaces and a sub-light region illuminated by the reflected light from the reflecting surface.

11 Claims, 4 Drawing Sheets

(51) Int. Cl.

| | |
|---|---|
| ***F25D 27/00*** | (2006.01) |
| ***A47F 3/04*** | (2006.01) |
| ***F21V 9/14*** | (2006.01) |
| ***F21S 4/20*** | (2016.01) |
| ***F21V 19/00*** | (2006.01) |
| ***F21W 131/305*** | (2006.01) |
| ***F21V 5/08*** | (2006.01) |
| ***F21S 4/28*** | (2016.01) |
| ***F21Y 103/10*** | (2016.01) |
| ***F21Y 115/10*** | (2016.01) |

(56) References Cited

U.S. PATENT DOCUMENTS 8,562,168 B2 * 10/2013 Napoli ..... F21S 8/026 362/147
2009/0002990 A1 * 1/2009 Becker ..... A47F 3/001 362/249.01
2011/0058357 A1 * 3/2011 Anderson ..... A47F 3/001 362/125
2011/0096551 A1 * 4/2011 Sekela ..... A47F 3/001 362/296.01
2013/0120974 A1 * 5/2013 Swisha ..... F21V 33/006 362/147
2016/0131311 A1 * 5/2016 Qin ..... F21S 4/28 362/92
2016/0348855 A1 * 12/2016 Zampini ..... F21V 5/08
2016/0377257 A1 * 12/2016 Xu ..... F21V 5/08 362/224
2016/0377258 A1 * 12/2016 Xu ..... F21V 5/04 362/223
2017/0292663 A1 * 10/2017 Pearson ..... F21S 8/033
2017/0292664 A1 * 10/2017 Pearson ..... F21V 21/088
2017/0370539 A1 * 12/2017 Xu ..... F21V 29/89
2018/0031189 A1 * 2/2018 Pearson ..... F21S 2/005

* cited by examiner

LIGHT DISTRIBUTION SYSTEM FOR FREEZER

CROSS-REFERENCE TO A RELATED APPLICATION

This application claims priority to a Chinese Patent Application No. CN 201711210135.0, filed on Nov. 28, 2017.

FIELD OF THE TECHNOLOGY

The present invention relates to lighting field, with particular emphasis on a light distribution system for freezer.

BACKGROUND

In the context of energy saving and environmental protection, LED lamps are increasingly used in home and commercial lighting because of their high light extraction efficiency and good light collecting performance. Since the LED chip that is once packaged can distribute light in its range of light angles and cannot meet the lighting requirements in most cases, it is generally required to use a lens for secondary light distribution processing. In the field of existing lighting, there is a need to have substantially uniform illumination at both the remote and near illumination. When the general light source is irradiated at different distances, because the far-illuminated surface has an irradiation area larger than the near-irradiated surface, the illumination energy per unit area on the far-illuminated surface is lower than that of the near-illuminated surface, thereby giving the human eye a brighter-dark difference and great visual experience.

LED lamp in the prior art generally take the form of fill light, for example, using at least two light sources of different light intensities. The light source is irradiated with a light source having a strong light intensity, and the light source having a weak light intensity is irradiated to the vicinity, so that the illumination has a lamp consistent with the vicinity of the illumination. Of course, the light sources having different light intensities may be processed by condensing or the like through a lens. However, such a method of supplementing light still has a problem of uneven light distribution in the illumination of the near-illuminated and distantly irradiated transitional illumination areas, thereby making the overall visual perception worse.

SUMMARY OF THE INVENTION

Therefore, the present invention provides a light distribution system for freezer to solve the above problem.

A light distribution system for freezer, the freezer including a freezer door, and an illuminated surface spaced from the freezer door, the light distribution system for freezer includes a LED strip lamp setting on the freezer door, the LED strip lamp comprising a lamp holder, a strip-shaped polarizing lens disposed on the lamp holder, and a plurality of LED chips, the lamp holder including a lens setting surface, and a reflecting surface intersecting the lens setting surface, the strip-shaped polarizing lens comprising a plurality of optical axis, an incident surface disposed perpendicular to the optical axis, and a first and second convex lens exit surface disposed on an opposite side of the incident surface, and a transition surface, the plurality of optical axis are spaced apart and arranged in a row, the first convex lens exit surface and the second convex lens exit surface are respectively disposed on two sides of the optical axis, a radius of curvature of a contour line of the first convex lens exit surface in a section perpendicular to an extending direction of the LED strip lamp gradually decreases in the direction toward the optical axis, a radius of curvature of a contour line of the second convex lens exit surface gradually decreases in the direction away from the optical axis, and a minimum radius of curvature of the contour line on the first convex lens exit surface is larger than a maximum radius of curvature of the contour line on the second convex lens exit surface, the transition surface is connected to the second convex lens exit surface and extends toward the reflecting surface, and an angle between the illuminated surface and the optical axis includes an acute angle on a cross section perpendicular to an extending direction of the strip-shaped polarizing lens, and the illuminated surface includes a main light region illuminated by the outgoing light of the first and second convex lens exit surfaces and a sub-light region illuminated by the reflected light of the reflecting surface, wherein the sub-light region is a projection area of the LED strip lamp on the illuminated surface, the reflecting surface receiving the outgoing light of the transition surface and directed it toward the sub-light region, and the light passing through the first convex lens exit surface is directed toward the illuminated surface close to the LED strip lamp and the light passing through the second convex lens exit surface is directed toward the illuminated surface far from the LED strip lamp.

Advantageously, a maximum distance of the projection of the first convex lens exit surface on the incident surface to the optical axis is greater than a maximum distance of the projection of the second convex lens exit surface on the incident surface to the optical axis in a cross section along the optical axis.

Advantageously, the optical axes are equally spaced apart.

Advantageously, the contour lines of the first convex lens exit surface and the second convex lens exit surface are formed by connecting a plurality of sub-arcs having a radius of curvature of equal difference series.

Advantageously, the contour line of the first convex lens exit surface has a radius of curvature ranging from 21 mm to 29 mm, and the contour line of the second convex lens exit surface has a radius of curvature ranging from 15 mm to 20 mm.

Advantageously, the reflecting surface is an arc.

Advantageously, the reflecting surface includes a plane connected to the lens setting surface, and a cambered surface disposed at a free end of the plane.

Advantageously, the plane is perpendicular to the lens setting surface in a section perpendicular to the extending direction of the LED strip lamp.

Advantageously, the transition surface includes a curved surface connected to the second convex lens exit surface and a flat surface connected to the curved surface in a cross section perpendicular to an extending direction of the LED strip lamp, the curvature of the curved surface 2341 with respect to the curvature of the LED chip 10 is negative.

Advantageously, the angle between the illuminated surface and the optical axis in the light exiting direction is between 45 degrees and 75 degrees.

Compared with the prior art, the minimum curvature radius of the contour line on the first convex lens exit surface of the strip-shaped polarizing lens of the LED strip lamp of the present invention is larger than the maximum curvature radius of the contour line on the second convex lens exit surface. Therefore, the second convex lens exit surface has a stronger focusing performance than the first convex lens exit surface. Moreover, the radius of curvature of the first convex lens exit surface gradually decreases in the direction toward the optical axis to gradually enhance the focusing performance and the radius of curvature of the second convex lens exit surface gradually decreases in the direction away from the optical axis to gradually enhance the focusing performance. Therefore, the irradiance in the irradiated area where the irradiation distance is gradually transitioned from near to far can be uniform while the first convex lens exit surface irradiates vicinity and the second convex lens exit surface irradiates remote area. In addition, due to the arrangement of the transition surface of the strip-shaped polarizing lens and the arrangement of the reflecting surface on the lamp holder, light can be irradiated onto the sub-light region of the illuminated surface, as a result, the entire illuminated surface is illuminated and the light experience can be improved.

DETAILED DESCRIPTION OF THE DRAWINGS

The drawings described herein are intended to promote a further understanding of the present invention, as follows.

DESCRIPTION OF THE PREFERRED EMBODIMENTS

Figure 1:
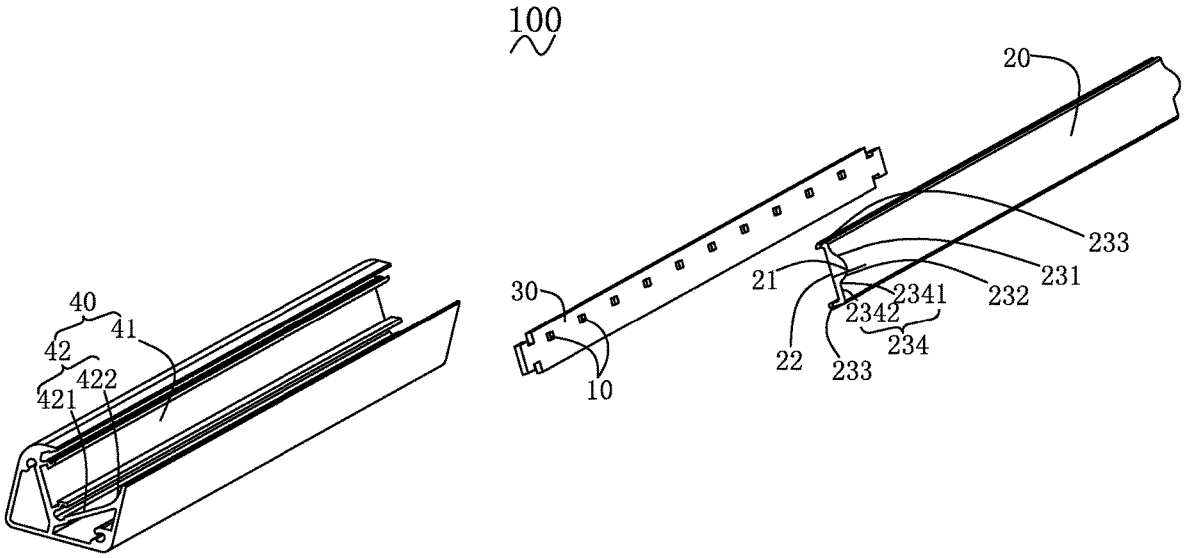
FIG. 1 is a schematic exploded view of an LED strip lamp provided by the present invention.

The present application is illustrated by way of the following detailed description based on of the accompanying drawings. It should be noted that illustration to the embodiment in this application is not intended to limit the invention.

Please refer to FIG. 1 to FIG. 4, which are schematic structural views and perspective exploded views of a light distribution system for freezer provided by the present invention. The light distribution system for freezer includes at least one LED strip lamp 100, and a freezer 200 for setting the LED strip lamp 100. It is of course conceivable that the light distribution system for the freezer further includes other functional modules, such as a mounting module for mounting the LED strip lamp 100, a power plug module, etc., it shall be a technology learned by technical personnel in the field.

The freezer 200 should be a well-known household or commercial electrical device for refrigerating or freezing some items such as food, medicines and the like. In particular, in commercial ice bins, in order to increase the customer's desire to purchase, lamps are often placed in the freezer 200 to illuminate the placed items. The freezer 200 includes at least one freezer door 201 and an illuminated surface 202 spaced from the freezer door 201. Typically, the freezer 200 includes a freezer door 201 or two freezer doors 201. The illuminated surface 202 is an item placed in the freezer 200. In the present embodiment, for the sake of simplicity, the illuminated surface 202 is a flat surface.

The LED strip lamp 100 is disposed on the freezer door 201. Since the freezer door 201 is typically a glass door, the LED strip lamp 100 is disposed on the side of the freezer door 201, typically the hinge of the freezer door 201 to the cabinet body (not labeled in the figure). The LED strip lamp 100 includes at least one LED chip 10, a strip-shaped polarizing lens 20 that cooperates with the LED chip 10, a circuit board 30 for arranging the LED chip 10, and a lamp holder 40 for setting the circuit board 30. It is conceivable that the LED strip lamp 100 further includes a power source or the like for driving the LED chip 10, which is not the focus of the present invention and will not be described herein.

The LED chip 10 serves as a light source of the LED strip lamp 100 to emit light. The number of the LED chips 10 is the same as the number of the optical axis 21 of the strip-shaped polarizing lenses 20 and each of the LED chips 10 is disposed corresponding to one optical axis 21. Therefore, the number of the LED chips 10 is also plural. In the present embodiment, the LED chips 10 are plural and arranged along the axial direction of the LED strip lamp 100 to conform to the illumination requirements of the strip light source forming by the LED strip lamp 100.

Figure 2:
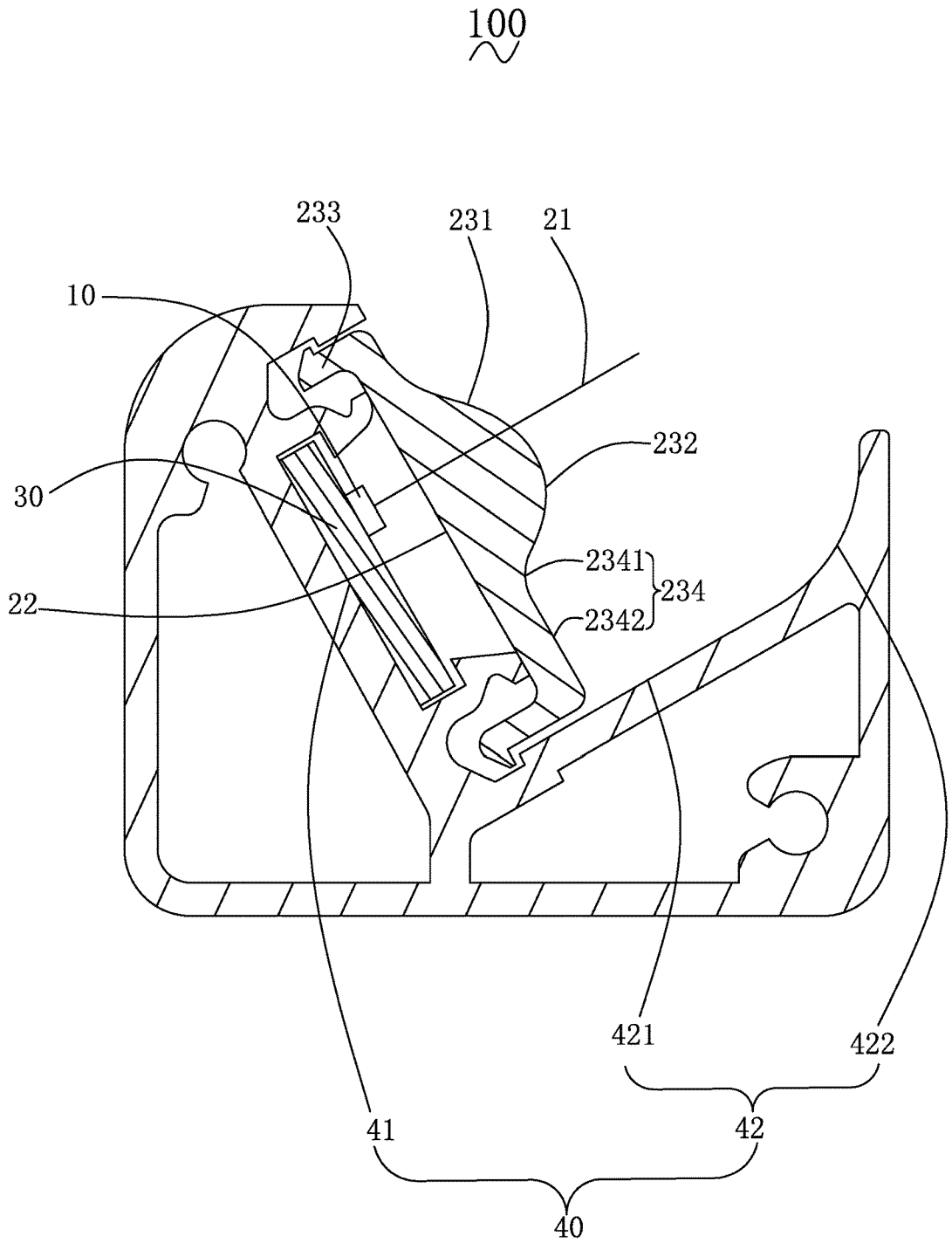
FIG. 2 is a cross-sectional structural view of the LED strip lamp of FIG. 1.
Figure 4:
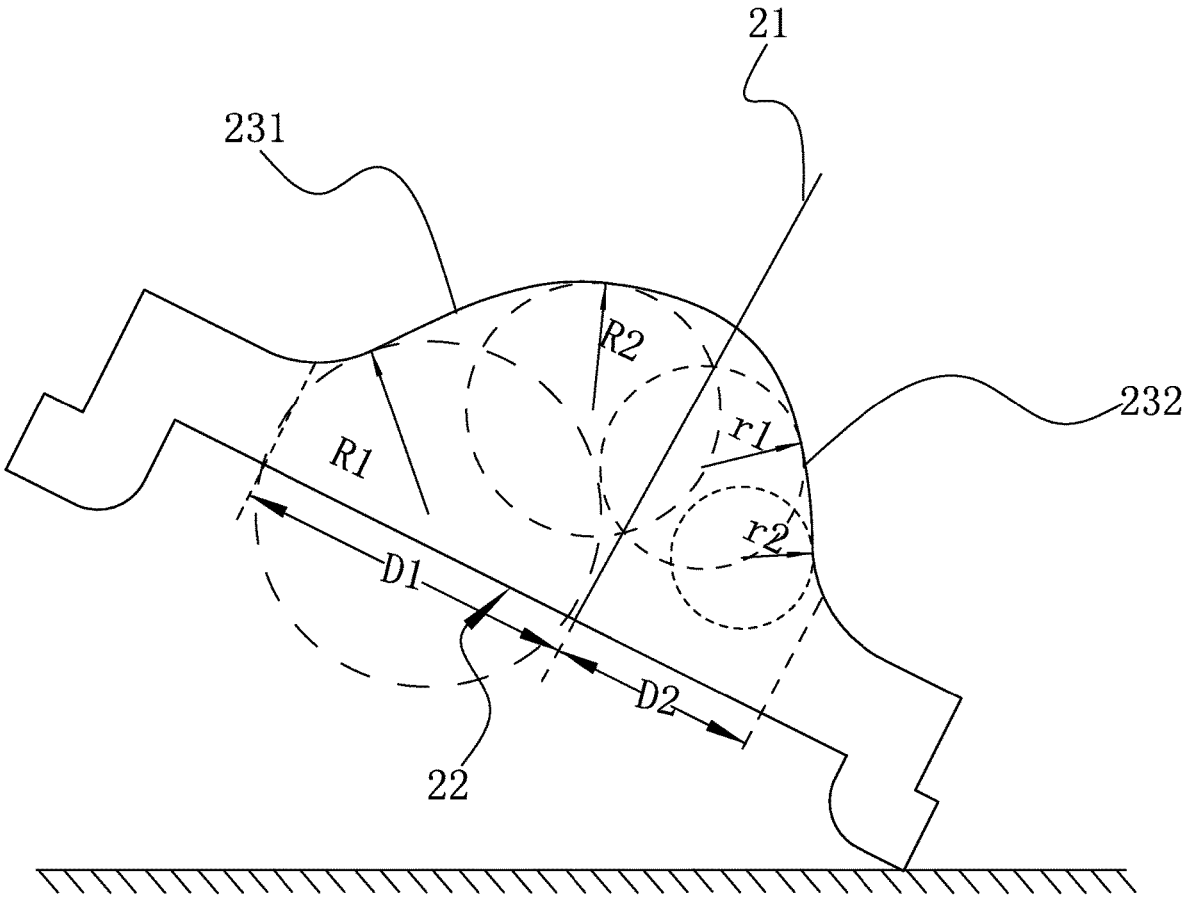
FIG. 4 is a schematic view showing the size of a strip-shaped polarizing lens of the LED strip lamp of FIG. 1.

Referring to FIG. 2 together, the strip-shaped polarizing lens 20 includes at least one optical axis 21, an incident surface 22 perpendicular to the optical axis 21, and a first convex lens exit surface 231 and a second convex lens exit surface 232 disposed on the opposite side of the incident surface 22, two mounting portions 233 respectively disposed on both sides of the first and second convex lens exit surfaces 231, 232, and a transition surface 234 disposed between one of the mounting portions 233 and the first portion convex lens exit surfaces 231. The strip-shaped polarizing lens 20 can be integrally formed by using a lens or a semi-lens of glass, plastic or the like. Further, the optical axis 21 are equally spaced apart such that a row of the plurality of LED chips 10 emit light through the strip-shaped polarizing lens 20 to form a uniform line source in the direction along the optical axis 21. In this embodiment, as shown in FIG. 4 and FIG. 5, the maximum distance of the first convex lens exit surface 231 projected onto the incident surface 22 to the optical axis 21 is greater than the maximum distance of the second convex lens exit surface 232 projected onto the incident surface 22 to the optical axis 21, such that the specific position of the optical axis 21 is D1 greater than D2. Since D1 is larger than the D2 setting, the emitted light of the LED chip 10 is reduced to be distributed to the first convex lens exit surface 231 and the second convex lens exit surface 232 is distributed with more light to compensate for the second convex lens exit surface 232 being emitted to the far side for attenuation of luminous flux. It is conceivable that the optical axis 21 is introduced in the present invention in order to better explain the structure of the strip-shaped polarizing lens 20 and the relative positional relationship with the LED chip 10 as a light source. In this embodiment, the optical axis 21 and the light exit center line of the LED chip 10 are geometrically coincident.

The incident surface 22 is for receiving light emitted by the LED chip 10. In the embodiment, the incident surface 22 is a plane, so that the angle at which the light emitted from the LED chip 10 is incident on the strip-shaped polarizing lens 20 through the incident surface 22 changes regularly and continuously to facilitate the designation and manufacture of the light exit angle of the first convex lens exit surface 231 and the second convex lens exit surface 232.

The first convex lens exit surface 231 and the second convex lens exit surface 232 are respectively disposed on both sides of the optical axis 21. The curvature radius of the contour line on the first convex lens exit surface 231 intersecting with the cross section along the optical axis 21 gradually decreases towards the direction close to the optical axis 21. The curvature radius of the contour line on the second convex lens exit surface 232 intersecting with the cross section along the optical axis 21 decreases gradually away from the optical axis 21, and a minimum curvature radius of the contour line on the first convex lens exit surface 231 is greater than a maximum curvature radius of the contour line on the second convex lens exit surface 232. As shown in FIG. 4, the curvature radius R2 of the contour line on the first convex lens exit surface 231 is smaller than R1. The curvature radius r2 of the contour line on the second convex lens exit surface 232 is smaller than r1. It is further noted that the "contour line" in the present invention referred to the arc of the same cross section of the strip-shaped polarizing lens 20 passing through any of the optical axis 21 and respectively intersects with the first convex lens exit surface 231 and the second convex lens exit surface 232.

In this embodiment, the contour lines of the first convex lens exit surface 231 and the second convex lens exit surface 232 are formed by connecting a plurality of sub-arcs having a radius of curvature of equal difference series. For example, the plurality of sub-arcs constituting the outline of the first convex lens exit surface 231 may have a radius of curvature of 22 mm, 23 mm, 24 mm, 25 mm, 26 mm, respectively, and the plurality of curvature radii have a tolerance of 1 mm. The plurality of sub-arcs constituting the outline of the second convex lens exit surface 232 may have a radius of curvature of 16.5 mm, 17 mm, 17.5 mm, 18 mm, 18.5 mm, respectively, and the tolerance of the radius of curvature of the plurality of sub-curves is 0.5 mm. Further, the contour line of the first convex lens exit surface 231 has a radius of curvature ranging from 21 mm to 29 mm. The contour line of the second convex lens exit surface 232 has a radius of curvature ranging from 15 mm to 20 mm. For example, the first convex lens exit surface 231 may be formed by connecting a plurality of contour lines having curvature radii of 21 mm, 22 mm, 23 mm, and 29 mm, respectively. The second convex lens exit surface 232 may be formed by connecting a plurality of contour lines having curvature radii of 15 mm, 16 mm, 17 mm, and 20 mm, respectively.

The mounting portion 233 is for assembling the strip-shaped polarizing lens 20 and is inserted into a slot of the lamp holder 40. The assembly structure of the mounting portion 233 should be a technique known to those skilled in the art and will not be described in detail herein.

The transition surface 234 is coupled between the one of the mounting portions 233 and the second convex lens exit surface 232. It is well known that the outgoing light of the LED chip 10 is a 180 degrees hemispherical shape, so that a certain portion of the light of the second convex lens exit surface 232 away from the side of the optical axis 21 is emitted. The portion of the exiting light will be directed toward the transition surface 234 and exited by the transition surface 234. The transition surface 234 includes a curved surface 2341 connected to the second convex lens exit surface 232 and a flat surface 2342 connected to the curved surface in a section perpendicular to the extending direction of the LED strip lamp. The curvature of the curved surface 2341 with respect to the curvature of the LED chip 10 is negative.

The circuit board 30 is used to set the LED chip 10. In this embodiment, the circuit board 30 is used to set a row of a plurality of LED chips 10 and to arrange a plurality of LED chips 10 at equal intervals. The circuit board 30, also referred to as a PCB (Printed Circuit Board), is used to carry the LED chip 10 and is capable of conducting power to drive the LED chip 10.

The lamp holder 40 is used to provide components such as the circuit board 30, the strip-shaped polarizing lens 20, and the like. The lamp holder 40 can be provided with the circuit board 30 by means of carding or plugging. The lamp holder 40 can be made of an aluminum profile. In the present embodiment, the lamp holder 40 is arranged in a strip shape in order to match the elongated arrangement of the LED chip 10. In the present embodiment, the lamp holder 40 includes a lens setting surface 41 and a reflecting surface 42 that intersects the lens setting surface 41. The lens setting surface 41 is for arranging the strip-shaped polarizing lens 20, and the circuit board 30. Specifically, the strip-shaped polarizing lens 20 and the circuit board 30 are fixed by slots on the lamp holder 40, but in order to ensure the accuracy and simplicity of the light distribution, the lamp holder 40 still has a virtual or physical lens setting surface 41 to mount the strip-shaped polarizing lens 20 and the circuit board 30. In the present embodiment, the lens setting surface 41 is parallel to the incident surface 22 of the strip-shaped polarizing lens 20. The reflecting surface 42 can be curved or otherwise shaped, which is designed according to actual light distribution requirements. In the present embodiment, the reflecting surface 42 includes a plane 421 connected to the lens setting surface 41, and a cambered surface 422 disposed at the free end of the plane 421. The plane 421 is perpendicular to the lens setting surface 41 in a section perpendicular to the extending direction of the LED strip lamp 100. The optical path of the outgoing light of the reflecting surface 42 will be described in detail below with the illuminated surface 202.

Figure 3:
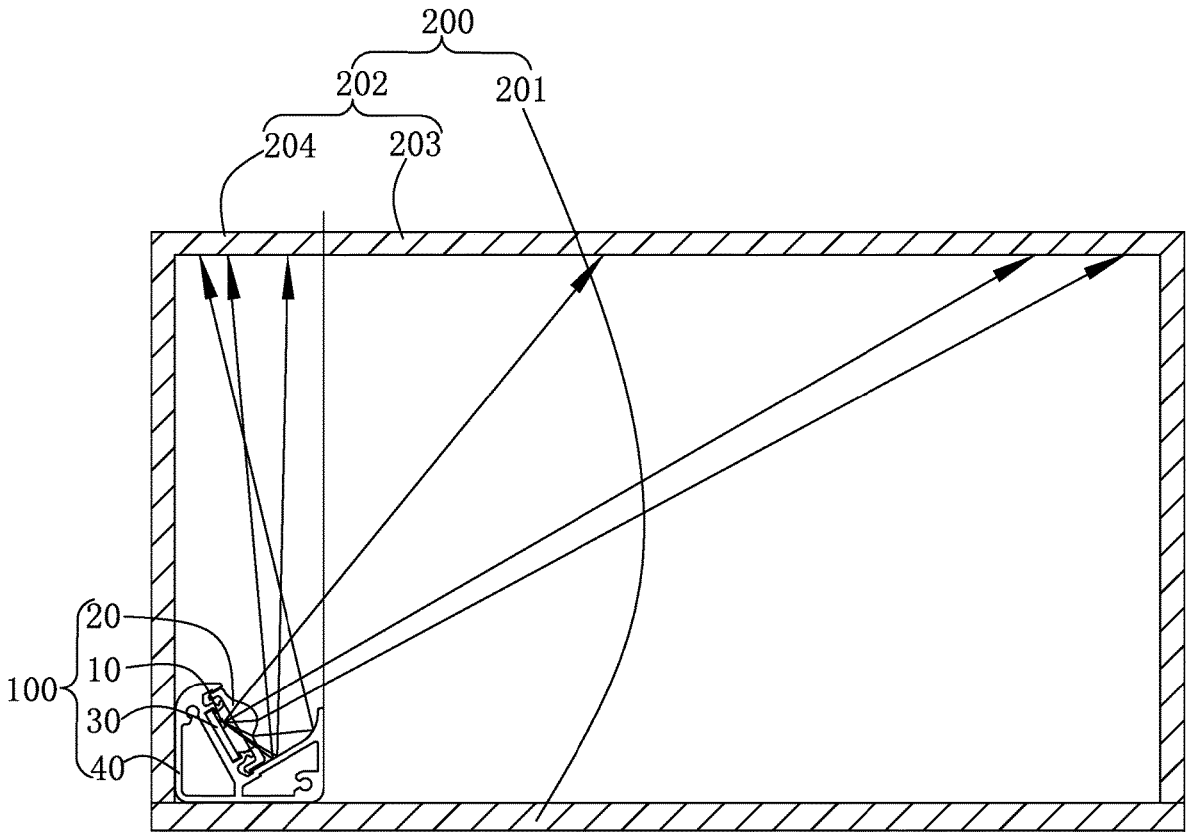
FIG. 3 is a schematic structural view and optical path diagram of a light distribution system for freezer provided by the present invention.

The installation of the LED strip lamp 100 of the present invention will be specifically described below by taking the vertical freezer installation environment as an example. The LED strip lamp 100 can be mounted as a unit on a vertical door of the freezer. The LED strip lamp 100 can also be two to meet the illumination requirements of a double door open freezer. At this time, the two LED strip lamps 100 are respectively disposed inside the freezer door to illuminate the inside of the freezer. As shown in FIG. 3, in the present embodiment, the LED strip lamp 100 is disposed on the side of the freezer door 201. The angle between the illuminated surface 202 and the optical axis 21 includes an acute angle on a section perpendicular to the extending direction of the LED strip lamp 100. At the same time, the light passing through the first convex lens exit surface 231 is directed toward the illuminated surface close to the LED strip lamp 100 and the light passing through the second convex lens exit surface 232 is directed toward the illuminated surface far from the LED strip lamp 100. Since the optical axis 21 is not perpendicular to the illuminated surface 202, and due to the deflection of the outgoing light of the LED chip 10 by the first and second convex lens exit surfaces 231, 232, the illuminated surface 202 includes a main light region 203 illuminated by the outgoing light of the first and second convex lens exit surfaces 231, 232 and a sub-light region 204 illuminated by the reflected light of the reflecting surface 42. The sub-light region 204 is a projection area of the LED strip lamp 100 on the illuminated surface 202. The reflecting surface 42 receives the outgoing light of the transition surface 234 and directs it toward the sub-light region 204. Specifically, the cambered surface 422 of the reflecting surface 42 receives the outgoing light of the curved surface 2341 of the transition surface 234, and the plane 421 of the reflecting surface 42 receives the outgoing light of the flat surface 2342 of the transition surface 234.

Compared with the prior art, the minimum curvature radius of the contour line on the first convex lens exit surface 231 of the strip-shaped polarizing lens 20 of the LED strip lamp 100 of the present invention is larger than the maximum curvature radius of the contour line on the second convex lens exit surface 232. Therefore, the second convex lens exit surface 232 has a stronger focusing performance than the first convex lens exit surface 231. Moreover, the radius of curvature of the first convex lens exit surface 231 gradually decreases in the direction toward the optical axis 21 to gradually enhance the focusing performance, and the radius of curvature of the second convex lens exit surface 232 gradually decreases in the direction away from the optical axis 21 to gradually enhance the focusing performance. Therefore, the irradiance in the irradiated area where the irradiation distance is gradually transitioned from near to far can be uniform while the first convex lens exit surface 231 irradiates vicinity and the second convex lens exit surface 232 irradiates remote area. In addition, due to the arrangement of the transition surface 234 of the strip-shaped polarizing lens 20 and the arrangement of the reflecting surface 42 on the lamp holder 40, light can be irradiated onto the sub-light region of the illuminated surface 202, as a result, the entire illuminated surface 202 is illuminated and the light experience can be improved.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A light distribution system for freezer, the freezer including a freezer door, and an illuminated surface spaced from the freezer door, characterized in that: the light distribution system for freezer includes a LED strip lamp setting on the freezer door, the LED strip lamp comprising a lamp holder, a strip-shaped polarizing lens disposed on the lamp holder, and a plurality of LED chips, the lamp holder including a lens setting surface, and a reflecting surface intersecting the lens setting surface, the strip-shaped polarizing lens comprising a plurality of optical axis, an incident surface disposed perpendicular to the optical axis, and a first and second convex lens exit surface disposed on an opposite side of the incident surface, and a transition surface, the plurality of optical axis are spaced apart and arranged in a row, the first convex lens exit surface and the second convex lens exit surface are respectively disposed on two sides of the optical axis, a radius of curvature of a contour line of the first convex lens exit surface in a section perpendicular to an extending direction of the LED strip lamp gradually decreases in the direction toward the optical axis, a radius of curvature of a contour line of the second convex lens exit surface gradually decreases in the direction away from the optical axis, and a minimum radius of curvature of the contour line on the first convex lens exit surface is larger than a maximum radius of curvature of the contour line on the second convex lens exit surface, the transition surface is connected to the second convex lens exit surface and extends toward the reflecting surface, and an angle between the illuminated surface and the optical axis includes an acute angle on a cross section perpendicular to an extending direction of the strip-shaped polarizing lens, and the illuminated surface includes a main light region illuminated by the outgoing light of the first and second convex lens exit surfaces and a sub-light region illuminated by the reflected light of the reflecting surface, wherein the sub-light region is a projection area of the LED strip lamp on the illuminated surface, the reflecting surface receiving the outgoing light of the transition surface and directed it toward the sub-light region, and the light passing through the first convex lens exit surface is directed toward the illuminated surface close to the LED strip lamp and the light passing through the second convex lens exit surface is directed toward the illuminated surface far from the LED strip lamp.

2. The light distribution system for freezer as claimed in claim 1, wherein a maximum distance of the projection of the first convex lens exit surface on the incident surface to the optical axis is greater than a maximum distance of the projection of the second convex lens exit surface on the incident surface to the optical axis in a cross section along the optical axis.

3. The light distribution system for freezer as claimed in claim 1, wherein the optical axes are equally spaced apart.

4. The light distribution system for freezer as claimed in claim 1, wherein the contour lines of the first convex lens exit surface and the second convex lens exit surface are formed by connecting a plurality of sub-arcs having a radius of curvature of equal difference series.

5. The light distribution system for freezer as claimed in claim 1, wherein the contour line of the first convex lens exit surface has a radius of curvature ranging from 21 mm to 29 mm, and the contour line of the second convex lens exit surface has a radius of curvature ranging from 15 mm to 20 mm.

6. The light distribution system for freezer as claimed in claim 1, wherein the reflecting surface is an arc.

7. The light distribution system for freezer as claimed in claim 1, wherein the reflecting surface includes a plane connected to the lens setting surface, and a cambered surface disposed at a free end of the plane.

8. The light distribution system for freezer as claimed in claim 7, wherein the plane is perpendicular to the lens setting surface in a section perpendicular to the extending direction of the LED strip lamp.

9. The light distribution system for freezer as claimed in claim 1, wherein the transition surface includes a curved surface connected to the second convex lens exit surface and a flat surface connected to the curved surface in a cross section perpendicular to an extending direction of the LED strip lamp, the curvature of the curved surface with respect to the curvature of the LED chip is negative.

10. The light distribution system for freezer as claimed in claim 1, wherein the angle between the illuminated surface and the optical axis in the light exiting direction is between 45 degrees and 75 degrees.

11. The light distribution system for freezer as claimed in claim 4, wherein the contour line of the first convex lens exit surface has a radius of curvature ranging from 21 mm to 29 mm, and the contour line of the second convex lens exit surface has a radius of curvature ranging from 15 mm to 20 mm.

* * * * *